US006238455B1

(12) United States Patent
Brown et al.

(10) Patent No.: US 6,238,455 B1
(45) Date of Patent: May 29, 2001

(54) HIGH-STRENGTH, TITANIUM-BEARING, POWDER METALLURGY STAINLESS STEEL ARTICLE WITH ENHANCED MACHINABILITY

(75) Inventors: Robert S. Brown, Leesport; Gregory J. Del Corso, Sinking Spring; Theodore Kosa, Reading; James W. Martin, Sinking Spring, all of PA (US)

(73) Assignee: CRS Holdings, Inc., Wilmington, DE (US)

( * ) Notice: Subject to any disclaimer, the term of this patent is extended or adjusted under 35 U.S.C. 154(b) by 0 days.

(21) Appl. No.: 09/425,664

(22) Filed: Oct. 22, 1999

(51) Int. Cl.[7] ..... C22C 1/04

(52) U.S. Cl. ..... 75/243; 75/244; 75/246; 419/11; 419/28; 419/49

(58) Field of Search ..... 75/243, 244, 246; 419/11, 28, 49

(56) References Cited

U.S. PATENT DOCUMENTS

| | | | | |
|---|---|---|---|---|
| 3,622,307 | * | 11/1971 | Clarke, Jr. . | |
| 3,696,486 | * | 10/1972 | Benjamin . | |
| 5,512,237 | * | 4/1996 | Stigenberg | 420/49 |
| 5,603,072 | * | 2/1997 | Kouno et al. | 419/25 |
| 5,681,528 | * | 10/1997 | Martin et al. | 420/53 |
| 5,720,300 | * | 2/1998 | Fagan et al. | 128/772 |

* cited by examiner

*Primary Examiner*—Ngoclan Mai
(74) *Attorney, Agent, or Firm*—Dann, Dorfman, Herrell and Skillman, P.C.

(57) ABSTRACT

A powder metallurgy article formed of a sulfur-containing, precipitation-hardenable, stainless steel alloy is described. The article has a unique combination of strength, ductility, processability, and machinability. The powder metallurgy article is formed of a stainless steel alloy having the following composition in weight percent.

| | |
|---|---|
| C | 0.03 max. |
| Mn | 1.0 max. |
| Si | 0.75 max. |
| P | 0.040 max. |
| S | 0.010–0.050 |
| Cr | 10–14 |
| Ni | 6–12 |
| Ti | 0.4–2.5 |
| Mo | 6 max. |
| B | 0.010 max. |
| Cu | 4 max. |
| Co | 9 max. |
| Nb | 1 max. |
| Al | 1 max. |
| Ta | 2.5 max. |
| N | 0.03 max. |

The balance of the alloy is iron and the usual impurities. The powder metallurgy article according to this invention is characterized by a fine dispersions of titanium sulfides that are not greater than about 5 $\mu$m in major dimension. A method of preparing the powder metallurgy article is also described.

16 Claims, No Drawings

HIGH-STRENGTH, TITANIUM-BEARING, POWDER METALLURGY STAINLESS STEEL ARTICLE WITH ENHANCED MACHINABILITY

FIELD OF THE INVENTION

This invention relates to precipitation hardenable stainless steel, and in particular to a powder metallurgy steel article formed of a sulfur-containing, precipitation-hardenable stainless steel that provides a unique combination of strength, processability, ductility, and machinability. The invention also relates to a method of making the powder metallurgy stainless steel article.

BACKGROUND OF THE INVENTION

Sulfur is used in many types of stainless steels to provide improved machinability. However, significant amounts of sulfur have typically not been used to enhance the machinability of high-strength, precipitation-hardenable stainless steels because such levels of sulfur adversely affect the processability of such steels and their ductility in the age-hardened condition. Here and throughout this application the term "processability" refers to the capability of a steel to be hot worked and/or cold worked to a desired cross-sectional dimension without sustaining significant damage (i.e., cracking, tearing, etc.). A need has arisen for a high-strength, precipitation-hardenable stainless steel that provides better machinability than the known grades of such steels, but which also provides sufficient processability to permit it to be formed into small diameter wire. It is also desired that the steel provide a combination of strength and ductility that is at least comparable to the known grades of high-strength, precipitation hardenable, stainless steels.

SUMMARY OF THE INVENTION

The disadvantages of the known cast-and-wrought grades of high-strength, precipitation hardenable, stainless steels are overcome to a large degree by a powder metallurgy article in accordance with one aspect of the present invention. In this aspect of the invention, a powder metallurgy article is provided that is formed of a precipitation hardenable stainless steel alloy powder having the broad, intermediate, and preferred weight percent compositions set forth in Table 1 below.

TABLE 1

| | Broad | Intermediate A | Intermediate B | Preferred A | Preferred B |
|---|---|---|---|---|---|
| C | 0.03 max. | 0.03 max. | 0.03 max. | 0.015 max. | 0.015 max. |
| Mn | 1.0 max. | 1.0 max. | 1.0 max. | 0.30 max. | 0.15 max. |
| Si | 0.75 max. | 0.75 max. | 0.75 max. | 0.30 max. | 0.15 max. |
| P | 0.040 max. | 0.040 max. | 0.040 max. | 0.010 max. | 0.010 max. |
| S | 0.010–0.050 | 0.020–0.040 | 0.020–0.040 | 0.020–0.030 | 0.020–0.030 |
| Cr | 10–14 | 10–13 | 10–13 | 11.0–12.0 | 11.0–12.0 |
| Ni | 6–12 | 8–10 | 10.5–11.6 | 8.0–8.8 | 10.8–11.3 |
| Ti | 0.4–2.5 | 1.0–1.5 | 1.5–2.0 | 1.0–1.4 | 1.5–1.8 |
| Mo | 6 max. | 0.50 max. | 0.25–1.5 | 0.30 max. | 0.8–1.1 |
| B | 0.010 max. | 0.010 max. | 0.010 max. | 0.0035 max. | 0.0015–0.0035 |
| Cu | 4 max. | 1.5–2.6 | 0.75 max. | 1.8–2.5 | 0.10 max. |
| Co | 9 max. | 0.75 max. | 0.75 max. | 0.10 max. | 0.10 max. |
| Nb | 1 max. | 0.10–0.50 | 0.3 max. | 0.20–0.30 | 0.10 max. |

TABLE 1-continued

| | Broad | Intermediate A | Intermediate B | Preferred A | Preferred B |
|---|---|---|---|---|---|
| Al | 1 max. | 0.25 max. | 0.25 max. | 0.05 max. | 0.05 max. |
| Ta | 2.5 max. | 0.3 max. | 0.3 max. | 0.10 max. | 0.10 max. |
| N | 0.03 max. | 0.03 max. | 0.03 max. | 0.010 max. | 0.010 max. |

The balance of the alloy powder composition is essentially iron and the usual impurities found in the same or similar grades of steels intended for the same or similar service. The powder metallurgy article according to this invention is formed by consolidating the metal powder to substantially full density and is characterized by a fine dispersion of sulfide particles not greater than about 5 $\mu$m in major dimension.

In accordance with another aspect of the present invention, there is provided a method of making precipitation-hardenable, stainless steel wire from metal powder. The process includes the step of melting a precipitation hardenable stainless steel alloy having a weight percent composition as set forth above. The molten alloy is then atomized to form a fine alloy powder. The alloy powder is hot consolidated to form an intermediate article and the intermediate article is mechanically worked to form wire.

The foregoing tabulation is provided as a convenient summary and is not intended thereby to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad, intermediate, or preferred composition can be used with the minimum or maximum for the same element in another preferred or intermediate composition. Here and throughout this application, the term "percent" or the symbol "%" means percent by weight, unless otherwise indicated.

DETAILED DESCRIPTION

The precipitation hardenable, stainless steel alloy used in the powder metallurgy article according to this invention contains at least about 10% chromium, and preferably at least about 11.0% chromium to benefit corrosion resistance. Too much chromium adversely affects the phase balance of the alloy and can lead to the formation of an undesirable amount of ferrite and to an excessive amount of retained austenite when the alloy is solution treated. Therefore, chromium is limited to not more than about 14%, better yet to not more than about 13%, and preferably to not more than about 12.0%.

At least about 6% and preferably at least about 8% nickel is present in the alloy used in the powder metallurgy article of this invention. Up to about 4%, preferably at least about 1.5% and better yet at least about 1.8% copper can be present in conjunction with nickel. Both nickel and copper contribute to the formation of a stable austenitic structure during solution treating prior to quenching the alloy to form martensite. Nickel and copper also contribute to the toughness and corrosion resistance of the alloy, and copper benefits the age hardening response of the alloy. Nickel is limited to not more than about 12% and copper to not more than about 2.6% because too much nickel and copper adversely affect the desired phase balance of the alloy and result in the formation of excessive retained austenite when the alloy is solution treated. Preferably, nickel is restricted to not more than about 10% and better yet to not more than about 8.8% in the alloy powder used in this invention, and copper is restricted to not more than about 2.5%.

Up to about 6% molybdenum can be present in the alloy because it contributes to the ductility and toughness of the alloy. Molybdenum also benefits the alloy's corrosion resistance in reducing media and in environments which promote pitting attack and stress-corrosion cracking. Molybdenum is restricted to not more than about 0.50% and preferably to not more than about 0.30% in the alloy powder because too much adversely affects the phase balance of the alloy, i.e., it leads to the undesirable formation of ferrite and to an excessive amount of retained austenite.

At least about 0.4% and preferably at least about 1.0% titanium is present in the alloy to provide hardness and strength by combining with available nickel to form a nickel-titanium-rich precipitate during age-hardening of the alloy. Titanium also combines with sulfur to form fine titanium sulfides that benefit the machinability of the powder metallurgy article in accordance with this invention. Too much titanium adversely affects the toughness and ductility of the alloy. Therefore, titanium is restricted to not more than about 2.5%, better yet to not more than about 1.5%, and preferably to not more than about 1.4% in a powder metallurgy article according to the present invention.

Up to about 1% niobium can be present in the alloy used in this invention to benefit toughness and age hardening response. For this purpose, the alloy contains at least about 0.10% and preferably at least about 0.20% niobium. Too much niobium adversely affects the phase balance of the alloy, producing retained austenite. Therefore, niobium is restricted to not more than about 0.50% and preferably to not more than about 0.30%.

In addition to the desirable combination of machinability and processability provided by the powder metallurgy article according to this invention, a unique combination of strength, notch toughness, and stress-corrosion cracking resistance is achieved by balancing the elements nickel, copper, molybdenum, titanium, and niobium differently from the above-described ranges for those elements. To that end at least about 10.5%, preferably at least about 10.8% nickel, at least about 0.25%, preferably at least about 0.8% molybdenum, and at least about 1.5% titanium are present in the alloy powder. When the nickel, copper, molybdenum, titanium, and niobium are not properly balanced, the alloy's ability to transform fully to a martensitic structure using conventional heat treating techniques is inhibited. Furthermore, the alloy's ability to remain substantially fully martensitic when solution treated and age-hardened is impaired. Under such conditions the strength of the powder article according to this invention is significantly reduced. Therefore, nickel is restricted to not more than about 11.6% and preferably to not more than about 11.3%. Copper is restricted to not more than about 0.75% and preferably to not more than about 0.10%. Molybdenum is limited to not more than about 1.5% and preferably to not more than about 1.1%., and titanium is restricted to not more than about 2.0% and preferably to not more than about 1.8%, and niobium is restricted to not more than about 0.3% and preferably to not more than about 0.10%.

At least about 0.010% and preferably at least about 0.020% sulfur is present in the powder metallurgy article of this invention. Sulfur combines with available titanium to form a distribution of very fine sulfides that provide enhanced machinability, but which do not adversely affect the processability of the material or its toughness and ductility in the age-hardened condition. Typically, an article formed in accordance with this invention contains a substantially uniform dispersion of titanium-sulfide particles not greater than about 5 $\mu$m in major dimension. The very fine titanium-sulfide particles benefit the machinability of the material, but do not detract from the hot and cold workability of the material. Too much sulfur ultimately affects processability and toughness adversely. Therefore, sulfur is restricted to not more than about 0.050%, better yet to not more than about 0.040%, and preferably to not more than about 0.030% in the powder metallurgy article according to this invention.

Up to about 1% aluminum and up to about 2.5% tantalum can be present in the powder metallurgy article of this invention because they benefit the strength and hardness of the article when it is age-hardened. Excess aluminum and tantalum adversely affect the ductility and processability of the article, and excess aluminum adversely affects its machinability. Therefore, aluminum is preferably restricted to not more than about 0.25% and tantalum is preferably restricted to not more than about 0.30%. For optimal ductility and processability, aluminum is restricted to not more than about 0.05% and tantalum is restricted to not more than about 0.10%.

Carbon and nitrogen are restricted in the powder metallurgy article of this invention because they combine with one or more of the elements titanium, niobium, and tantalum to form carbides, nitrides, and/or carbonitrides which adversely affect the machinability of the powder metallurgy article. For that reason carbon is restricted to not more than about 0.03%, preferably to not more than about 0.015%, and nitrogen is restricted to not more than about 0.03%, preferably to not more than about 0.010%.

Up to about 9% cobalt can be present in substitution for some of the nickel to benefit the phase balance and toughness of the powder metallurgy article of this invention. More typically, cobalt is limited to not more than about 0.75% and preferably to not more than about 0.10% because it is usually more expensive than nickel. Up to about 0.010% boron can be present because it contributes to the hot workability of the powder metallurgy article according to this invention and the ductility and toughness of the article in the age-hardened condition. Preferably at least about 0.0015% boron is present for such purpose. Boron is preferably limited to not more than about 0.0035%.

Up to about 1.0% manganese and up to about 0.75% silicon can be present in the powder metallurgy article of this invention as retained amounts from deoxidizing additions made during melting of the alloy. Manganese and silicon are preferably restricted to not more than about 0.30% each, and better yet to not more than about 0.15% each because they can undesirably affect the phase balance of the alloy and the desired combination of properties provided by the powder metallurgy article.

The balance of the alloy is essentially iron except for the usual impurities found in commercial grades of steels intended for similar service. Among such impurities is phosphorus which is restricted to not more than about 0.040%, preferably to not more than about 0.010%, because it adversely affects the mechanical properties of articles made in accordance with this invention, particularly toughness.

The powder metallurgy article according to this invention is made by melting a heat of the alloy described above. Melting is preferably performed by vacuum induction melting (VIM) under a partial pressure of argon gas. The molten alloy is atomized, preferably with argon gas, and cooled under a cover of argon gas in the atomization chamber to prevent surface oxidation of the alloy powder particles. After cooling, the alloy powder is screened to a desired size and may be blended with other heats of powder of the desired composition to provide a homogeneous mixture. The maximum powder particle size can be up to about −40 mesh (420 μm) when the alloy powder is very clean, i.e., very few inclusions. Preferably, a particle size of about −80 mesh (177 μm) is used to reduce the number of coarse inclusions. For best results, the powder is screened to about −100 mesh (149 μm). After screening and blending, the alloy powder is loaded into a compatible steel container. The container material is preferably T304 stainless steel, but can also be made of mild steel. The alloy powder is loaded into the container at room temperature. Prior to sealing, the filled container is evacuated to a pressure of less than 1 mm Hg at an elevated temperature of at least about 250° F. (121° C.) and preferably at about 400° F. (204° C.) to remove oxygen and any moisture from the canister. Temperatures up to about 2100° F. (1149° C.) can also be utilized in order to maximize the removal of moisture.

The container is then sealed and hot consolidated to provide a substantially fully dense compact. The preferred hot consolidation method is hot isostatic pressing (HIP'ng) which is carried out at a temperature in the range of about 2000–2200° F. (1093–1204° C.) and at a pressure sufficient to assure bonding of the powder particles, preferably at about 15 ksi (103 MPa) for about 4 hours. Other pressures and time periods can be utilized depending on the capabilities of the HIP'ng vessel and the desired cycle time. The HIP'ng cycle is selected to provide a compact that is at least about 94–95% of theoretical density, i.e., one that has essentially no interconnected porosity.

The HIP'd compact is then hot worked, such as by hot rolling, forging or pressing, to form billet which is then further hot rolled to form rod. Hot working and/or hot rolling are carried out from a temperature of about 2000–2100° F. (1093–1149° C.). At some point after hot rolling, the stainless steel cladding formed by the container is removed by any suitable process, such as shaving.

The rod can be processed to intermediate redraw wire by a variety of methods. In one preferred process, the hot-rolled rod is solution treated as described below, followed by shaving and polishing. When the article is formed from alloy powder having the composition of Alloy A in Table 1, it is preferably batch solution annealed at about 1400–1600° F. (760–871° C.) for from one quarter of an hour to about 2 hours and then water quenched. When the article is formed from alloy powder having the composition of Alloy B in Table 1, it is preferably batch solution annealed at about 1700–1900° F. (927–1038° C.) for about one hour followed by quenching in water. An article made from alloy powder having the composition of Alloy B is preferably subjected to a deep chill treatment after it is quenched, to further develop the high strength that is characteristic of this article. The deep chill treatment cools the alloy to a temperature sufficiently below the martensite finish temperature to ensure the completion of the martensite transformation and the minimization of retained austenite. When used, the deep chill treatment consists of cooling the alloy to about −100° F. (−73° C.) or lower, for about 1 to 8 hours, depending on the cross-sectional size of the article. The need for the deep chill treatment depends in part on the martensite finish temperature of the alloy. If the martensite finish temperature is sufficiently high, the transformation from austenite to martensite will proceed to completion without the need for a deep chill treatment.

In an alternative process, the hot-rolled rod is shaved and polished and then overaged to prevent cracking during subsequent acid cleaning or cold working. The overaging treatment consists of heating the material at a temperature sufficient to put the material in the overaged condition. Good results have been obtained by overaging at about 1150° F. (621° C.) for up to 4 hours followed by cooling in air. The rod is then cold worked, preferably by drawing, to form an intermediate size wire. After the initial cold working, the intermediate wire is solution annealed.

Whatever the method of producing the intermediate solution annealed redraw wire, the wire is further drawn or cold-worked to form smaller cross-sectional sizes. Intermediate annealing treatments may be applied between successive reductions. The wire can then be formed into useful product forms. For example, wire prepared in accordance with this invention is especially suited for making surgical needles. The needles can be easily drilled for attachment of the suture material. Regardless of the form of the final product, it is age hardened to achieve the desired high strength. Age hardening is preferably conducted by heating the products at a suitable aging temperature for an appropriate amount of time, followed by cooling in air. The preferred aging temperature is in the range of about 800–1100° F. (427–593° C.). Good results have been achieved when the articles are held at temperature for about 4 hours.

EXAMPLES

To demonstrate the unique combination of properties provided by the powder metallurgy article made in accordance with this invention, wire was formed from four alloys having the weight percent compositions set forth in Table 2 below.

TABLE 2

| Element | Example 1 | Example 2 | Heat A | Heat B |
|---|---|---|---|---|
| C | 0.004 | 0.005 | 0.004 | 0.012 |
| Mn | 0.01 | 0.01 | 0.01 | 0.01 |
| Si | 0.03 | 0.04 | 0.04 | 0.04 |
| P | 0.002 | 0.006 | 0.002 | 0.006 |
| S | 0.027 | 0.0209 | 0.109 | 0.0751 |
| Cr | 11.42 | 11.60 | 11.48 | 11.60 |
| Ni | 8.26 | 11.07 | 8.33 | 11.04 |
| Mo | 0.02 | 0.95 | 0.02 | 0.95 |
| Cu | 2.16 | 0.01 | 2.17 | <0.01 |
| Ti | 1.12 | 1.51 | 1.10 | 1.51 |
| Nb | 0.23 | 0.01 | 0.23 | 0.01 |
| N | 0.0018 | 0.0010 | 0.0019 | 0.0021 |
| O | 0.0242 | 0.0241 | 0.0243 | 0.0382 |
| B | 0.0019 | 0.0028 | 0.0021 | 0.0030 |
| Al | 0.08 | 0.08 | 0.09 | 0.08 |

300 lb. (nominal) heats of Examples 1 and 2 and comparative Heats A and B were vacuum induction melted under a partial pressure of argon gas. Each heat was atomized with argon gas and cooled in an argon atmosphere in the atomizing chamber. The powder from each heat was screened to −100 mesh, blended, and filled into 8" round T304 stainless steel canisters in air. The filled canisters were evacuated to less than 1 mm Hg, heated at 400° F. (204° C.), and then sealed. Each canister was then HIP'd at 2050° F. (1121° C.) and 15 ksi (103 MPa) for 4 hours to form a nominal 7.2 in. (18.3 cm) diameter compact.

The HIP'd compacts of Example 1 and Heat A were rotary forged from a temperature of 2100° F. (1149° C.) to 4.25 in. (10.8 cm) diameter round billet. The HIP'd compacts of Example 2 and Heat B were rotary forged from a temperature of 2000° F. (1093° C.) to 4.25 in. (10.8 cm) diameter round billet. The billets were heated at 1148° F. (620° C.) for 4 hours to overage them and then cooled in air. The overaging operation was performed to prevent cracking of the billet during abrasive cutting. The billets of Example 1 and Heat A were then hot rolled from 2100° F. (1149° C.) to 0.2656 in. (6.75 mm) rod and the billets of Example 2 and Heat B were hot rolled from 2000° F. (1093° C.) to the same dimension. The rod material from each heat was shaved and polished to 0.244 in. (6.2 mm) diameter to remove the stainless steel cladding, overaged at 1148° F. (620° C.) for 4 hours and cooled in air, and then acid cleaned. The rod from each heat was then cold drawn to 0.218 in. (5.5 mm) diameter wire and then solution annealed in vacuum. The wire from Example 1 and Heat A was solution annealed at 1508° F. (820° C.) for 2 hours and water quenched. The wire from Example 2 and Heat B was solution annealed at 1796° F. (980° C.) for 1 hour, water quenched, deep chilled at −100° F. (−73° C.) for 8 hours, and then warmed in air. All of the wire was then acid cleaned.

The wire from each heat was cold drawn to 0.154 in. (3.9 mm) diameter round and then strand annealed. The strand annealing of the wire from Example 1 and Heat A was car red out at 1750° F. (954° C.) at a transport rate of 8 feet per minute (fpm) (2.4 m/min.). The wire from Example 2 and Heat B was strand annealed at 1900° F. (1038° C.) at a transport rate of 8 fpm (2.4 m/min.). The wire from each heat was then cold drawn to 0.128 in. (3.25 mm) diameter round, followed by strand cleaning.

No problem, such as cracking or tearing, was encountered during the processing of these heats. The wire from Examples 1 and 2 was subjected to further cold drawing to 0.024 in. (0.6 mm) diameter round wire with no apparent problems. However, the wire from Heats A and B experienced breakage when subjected to a similar amount of cold drawing. Thus, it appears that a powder metallurgy article formed of a high strength precipitation hardenable stainless steel alloy containing about 0.1% sulfur does not provide adequate processability when subjected to heavy cold drawing.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A consolidated, powder-metallurgy article comprising a precipitation-hardenable stainless steel alloy consisting essentially of, in weight percent, about

| | |
|---|---|
| Carbon | 0.03 max. |
| Manganese | 1.0 max. |
| Silicon | 0.75 max. |
| Phosphorus | 0.040 max. |
| Sulfur | 0.010–0.050 |
| Chromium | 10–14 |
| Nickel | 6–12 |
| Molybdenum | 6 max. |
| Copper | 4 max. |
| Titanium | 0.4–2.5 |
| Aluminum | 1 max. |
| Niobium | 1 max. |
| Tantalum | 2.5 max. |
| Cobalt | 9 max. |

-continued

| | |
|---|---|
| Boron | 0.010 max. |
| Nitrogen | 0.03 max. |

and the balance essentially iron and the usual impurities, said powder-metallurgy article containing a fine dispersion of minute sulfide particles that are not greater than 5 $\mu$m in major dimension.

2. A powder metallurgy article as set forth in claim 1 containing, in weight percent, about

| | |
|---|---|
| Nickel | 8–10 |
| Titanium | 1.0–1.5 |
| Molybdenum | 0.50 max. |
| Copper | 1.5–2.6 |
| Niobium | 0.10–0.50. |

3. A powder metallurgy article as set forth in claim 1 containing, in weight percent, about

| | |
|---|---|
| Nickel | 10.5–11.6 |
| Titanium | 1.50–2.0 |
| Molybdenum | 0.25–1.5 |
| Copper | 0.75 max. |
| Niobium | 0.3 max. |

4. Wire formed from a consolidated powder metallurgy article that comprises a precipitation-hardenable stainless steel alloy consisting essentially of, in weight percent, about

| | |
|---|---|
| Carbon | 0.03 max. |
| Manganese | 1.0 max. |
| Silicon | 0.75 max. |
| Phosphorus | 0.040 max. |
| Sulfur | 0.010–0.050 |
| Chromium | 10–14 |
| Nickel | 6–12 |
| Molybdenum | 6 max. |
| Copper | 4 max. |
| Titanium | 0.4–2.5 |
| Aluminum | 1 max. |
| Niobium | 1 max. |
| Tantalum | 2.5 max. |
| Cobalt | 9 max. |
| Boron | 0.010 max. |
| Nitrogen | 0.03 max. |

and the balance essentially iron and the usual impurities, said powder-metallurgy article containing a fine dispersion of minute sulfide particles that are not greater than 5 $\mu$m in major dimension.

5. Wire formed from a powder metallurgy article as set forth in claim 4 containing, in weight percent, about

| | |
|---|---|
| Nickel | 8–10 |
| Titanium | 1.0–1.5 |
| Molybdenum | 0.50 max. |
| Copper | 1.5–2.6 |
| Niobium | 0.10–0.50. |

6. Wire formed from a powder metallurgy article as set forth in claim 4 containing, in weight percent, about

| | |
|---|---|
| Nickel | 10.5–11.6 |
| Titanium | 1.5–2.0 |
| Molybdenum | 0.25–1.5 |
| Copper | 0.75 max. |
| Niobium | 0.3 max. |

7. A method of making steel wire comprising the steps of: melting a precipitation hardenable stainless steel alloy consisting essentially of, in weight percent, about

| | |
|---|---|
| Carbon | 0.03 max. |
| Manganese | 1.0 max. |
| Silicon | 0.75 max. |
| Phosphorus | 0.040 max. |
| Sulfur | 0.010–0.050 |
| Chromium | 10–14 |
| Nickel | 6–12 |
| Molybdenum | 6 max. |
| Copper | 4 max. |
| Titanium | 0.4–2.5 |
| Aluminum | 1 max. |
| Niobium | 1 max. |
| Tantalum | 2.5 max. |
| Cobalt | 9 max. |
| Boron | 0.010 max. |
| Nitrogen | 0.03 max. |

and the balance essentially iron and the usual impurities;

gas atomizing said alloy to form an alloy powder;

consolidating said alloy powder under conditions of temperature, pressure, and time sufficient to form an intermediate article that is substantially fully dense; and mechanically working said intermediate article to form wire therefrom.

8. The method set forth in claim 7 wherein the step of consolidating the alloy powder comprises the step of hot isostatically pressing the alloy powder.

9. The method set forth in claim 7 wherein the step of melting the alloy is performed under a partial pressure of argon gas.

10. The method set forth in claim 7 wherein the atomizing step is performed with argon gas.

11. The method set forth in claim 7 further comprising the steps of: filling the alloy powder into a metal canister; evacuating the metal canister to a subatmospheric pressure; and then sealing the canister.

12. The method set forth in claim 7 wherein the step of mechanically working the intermediate article comprises the steps of:

hot working the intermediate article at a temperature in the range of about 2000–2100° F. (1093–1149° C.); and removing the canister from the intermediate article.

13. The method set forth in claim 7 wherein the steel alloy contains in weight percent, about

| | |
|---|---|
| Nickel | 8–10 |
| Molybdenum | 0.50 max. |
| Copper | 1.5–2.6 |
| Titanium | 1.0–1.5 |
| Niobium | 0.10–0.50; and |

the intermediate article is solution treated by heating at a temperature in the range of about 1400–1600° F. (760–871° C.) for about ¼ hour to about 2 hours, and then quenched.

14. The method set forth in claim 7 wherein the steel alloy contains in weight percent, about

| | |
|---|---|
| Nickel | 10.5–11.6 |
| Molybdenum | 0.25–1.5 |
| Copper | 0.75 max. |
| Titanium | 1.5–2.0 |
| Niobium | 0.30 max.; and |

the intermediate article is solution treated by heating at a temperature in the range of about 1700–1900° F. (927–1038° C.) for about one hour, and then quenched.

15. The method set forth in claim 14 further comprising the step of cooling the solution treated intermediate article to a temperature of about −100° F. (−73° C.) or lower for about 1 to 8 hours.

16. The method set forth in claim 7 comprising the further step of averaging the intermediate article by heating at a temperature of about 1150° F. (621° C.) for up to about 4 hours.

* * * * *

UNITED STATES PATENT AND TRADEMARK OFFICE

CERTIFICATE OF CORRECTION

PATENT NO. : 6,238,455 B1
APPLICATION NO. : 09/425664
DATED : September 2, 2004
INVENTOR(S) : Brown et al.

It is certified that error appears in the above-identified patent and that said Letters Patent is hereby corrected as shown below:

Column 7, lines 23-24, “car red” should read -- carried --;

Column 10, line 42, Claim 16, line 2, “averaging” should read -- overaging --;

Signed and Sealed this

Seventeenth Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 6,238,455 B1
APPLICATION NO. : 09/425664
DATED : May 29, 2001
INVENTOR(S) : Brown et al.

It is certified that error appears in the above-identified patent and that said Letters Patent is hereby corrected as shown below:

Column 7, lines 23-24, “car red” should read -- carried --;

Column 10, line 42, Claim 16, line 2, “averaging” should read -- overaging --;

This certificate supersedes Certificate of Correction issued July 17, 2007.

Signed and Sealed this

Fourth Day of September, 2007

JON W. DUDAS
*Director of the United States Patent and Trademark Office*